US005341525A

United States Patent [19]

Tillman et al.

[11] Patent Number: 5,341,525

[45] Date of Patent: Aug. 30, 1994

[54] SHOWER LOUNGE CHAIR

[75] Inventors: Dorothy M. Tillman, Brandon; Robert L. Marion, Jackson, both of Miss.

[73] Assignee: Spartan Health Care Products, Inc., Jackson, Miss.

[21] Appl. No.: 182,827

[22] Filed: Jan. 19, 1994

[51] Int. Cl.[5] ..... A47K 3/12

[52] U.S. Cl. ..... 4/579; 4/573.1

[58] Field of Search ..... 4/560.1, 561.1, 562.1, 4/563.1, 564.1, 565.1, 566.1, 571.1, 573.1, 575.1, 578.1, 579

[56] References Cited

U.S. PATENT DOCUMENTS

| | | | |
|---|---|---|---|
| 2,491,223 | 12/1949 | Stadlman | 4/572.1 |
| 2,968,814 | 1/1961 | Ashby, Jr. | 4/564.1 |
| 3,252,167 | 5/1966 | Eddy | 4/578.1 |
| 3,366,978 | 2/1968 | Jones | 4/578.1 X |
| 4,128,904 | 12/1978 | Ekman et al. | 4/540 |
| 4,166,297 | 9/1979 | Saleeby | 4/578.1 |
| 4,230,364 | 10/1980 | Parker | 4/560.1 |
| 4,475,256 | 10/1984 | Hatala | 4/562.1 |
| 4,662,852 | 5/1987 | Schneider et al. | 441/132 |
| 4,719,653 | 1/1988 | Bishop et al. | 4/572.1 |
| 4,837,869 | 6/1989 | Simmon | 4/496 |
| 5,097,542 | 3/1992 | Roesler | 4/579 |
| 5,160,185 | 11/1992 | Stang | 297/377 |

FOREIGN PATENT DOCUMENTS

| | | | |
|---|---|---|---|
| 0240882 | 11/1911 | Fed. Rep. of Germany | 4/573.1 |
| 0661934 | 7/1929 | France | 4/579 |

OTHER PUBLICATIONS

Electric Mobility Dignity Bath (undated).
Clark Bath Lift Aug. 1993.
Clark Water Powered Bath Lift (undated).
Aquatec+Minor Aquatec Bath Lift (undated).
Aquatec Minor and Major Bath Lift (undated).

*Primary Examiner*—Robert M. Fetsuga
*Attorney, Agent, or Firm*—Laubscher & Laubscher

[57] ABSTRACT

A shower lounge chair for supporting an individual in a bathtub is characterized by a horizontal frame which rests on the side walls of the bathtub and includes adjustable laterally extending struts which are braced against the bathtub side walls. A back rest and a leg rest are pivotally connected with the frame and hydraulic pistons are connected between the frame and the back rest and leg rest to independently control the position of each. More particularly, the back rest is pivoted between a lower position parallel to the frame and an upper position perpendicular to the frame so that an individual may be supported in selected positions between prone and upright positions. The leg rest is pivoted between a lower downwardly extending position and an upper position parallel to the frame for supporting the legs and feet of the individual in selected positions within or above the bathtub.

9 Claims, 2 Drawing Sheets

SHOWER LOUNGE CHAIR

BACKGROUND OF THE INVENTION

When bathing the elderly, handicapped, or disabled in a bathtub, it is important to guard against slipping or falling in the tub. It is also often necessary to assist the individual during entering or exiting the tub.

The present invention relates to an adjustable, portable, shower lounge chair for supporting individuals while bathing or showering in a bathtub. The chair prevents individuals from slipping or falling while bathing and while entering or leaving the tub. It is a beneficial bathing aid for individuals and care givers in homes, hospitals, burn centers, rehabilitation centers, nursing homes, and mental institutions.

BRIEF DESCRIPTION OF THE PRIOR ART

Bathing aids for supporting individuals in a bathtub are well-known in the prior art as evidenced by U.S. Pat. No. 3,252,167. This patent discloses a bathtub safety seat including a tubular frame seat member having a seat made from a moisture resistant fabric, grabrails connected with the sides of the seat, mounting brackets for securing to the inner walls of the tub, and a threaded, telescoping rod which rotatably connects one end of the seat to the mounting brackets.

Also known in the art are adjustable body supports as shown in U.S. Pat. No. 4,719,653. Such supports include a seat portion for supporting the lower torso of an individual and a back portion for supporting the upper torso of the individual. The back portion is selectively adjustable in a series of incremental positions.

While the prior devices normally operate satisfactorily, they suffer from certain inherent drawbacks which limit their ability to prevent accidents and the like when bathing the elderly or infirm. The prior devices are also lacking in seating comfort, complete body support and durability, and are cumbersome and in some cases expensive.

The present invention was developed in order to overcome these and other drawbacks by providing a lightweight, inexpensive, adjustable shower lounge chair which can be used with average sized bathtubs to safely and reliably support individuals for bathing in prone or upright positions.

SUMMARY OF THE INVENTION

Accordingly, it is a primary object of the present invention to provide a shower lounge chair for supporting an individual while bathing or showering in a bathtub. The chair includes a horizontal frame which rests on the side walls of the bathtub and has adjustable cross members for securing the frame within the tub. A back rest is pivotally connected with the frame for movement between a lower position wherein the back rest is parallel to the frame and an upper position wherein the back rest is perpendicular to the frame. A leg rest is also pivotally connected with the frame for movement between a lower position wherein the leg rest is perpendicular to the frame and an upper position wherein the leg rest is parallel to the frame. Hydraulic cylinders having movable pistons are connected between the frame and the back rest and the leg rest to independently pivot the back rest and leg rest between the lower and upper positions, respectively.

According to a more specific object of the invention, a fluid source is connected with the back rest and leg rest piston/cylinders via valves to independently control the delivery of fluid to and from the piston/cylinders.

It is a further object of the invention to provide struts threadably connected with the frame crossmembers. The struts are laterally extendable to brace the frame against the side walls of the bathtub.

A perforated fabric is connected with the frame, back rest, and leg rest to provide a comfortable surface for supporting the individual in a selected bathing position.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
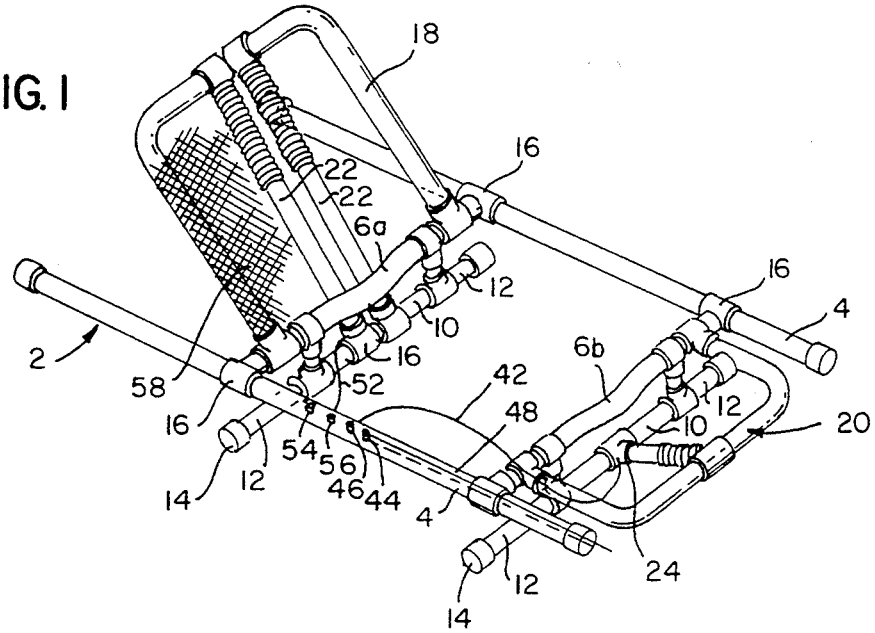
FIG. 1 is a partial perspective view of the shower lounge chair according to the invention.
Figure 2:
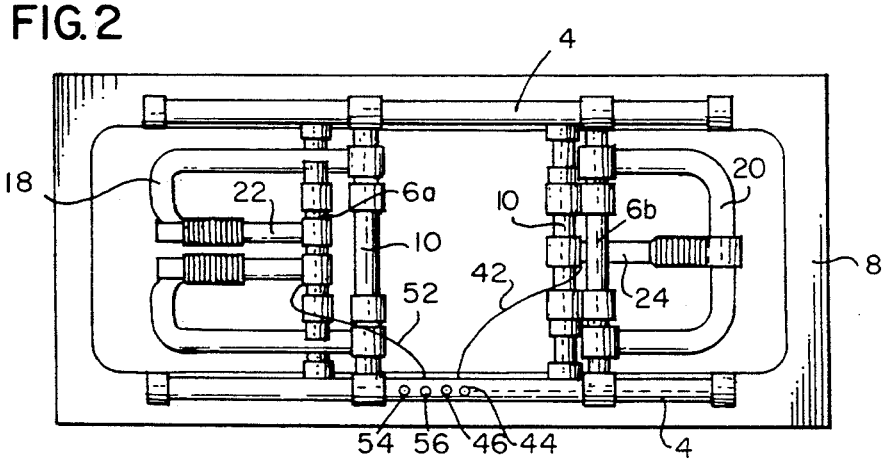
FIG. 2 is a top view of the chair of FIG. 1 shown as mounted in a bathtub.
Figure 3:
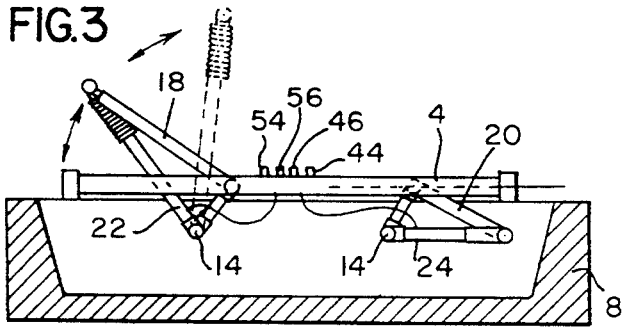
FIGS. 3 and 4 are cutaway side and end views, respectively, of the chair of FIG. 2.
Figure 4:
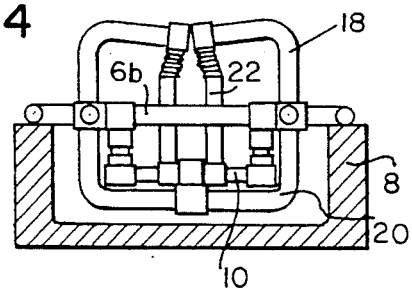

Referring first to FIGS. 1–4, the shower lounge chair of the invention will be described. The chair includes a horizontal frame 2 having a spaced pair of longitudinal members 4 and a pair of spaced lateral members *6a,b* slidably connected at their ends with the longitudinal members. The longitudinal members are telescopic members adjustable longitudinally to rest on the side walls of a bathtub 8 as shown in FIGS. 2–4.

Figure 5:
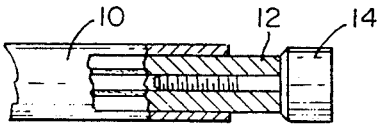
FIG. 5 is a sectional view of an adjustable strut for bracing the chair of FIG. 1 in a bathtub.

Suspended from the lateral members *6a,6b* are a pair of telescoping cross beams 10. At each end of the cross beams are provided struts 12 which are threadably connected with the cross beams as shown in FIG. 5 for lateral extension into engagement with the side walls of the bathtub. The struts are rotated by hand and serve to brace the chair within the tub to prevent displacement of the chair when in use. To prevent slippage of the struts, end caps 14 formed of synthetic rubber are provided at the ends of the struts which engage the tub side walls.

The lateral and longitudinal members and the cross beams of the frame are formed of an inexpensive, light weight rigid material such as polyvinyl chloride (PVC). The members and cross beams are preferably configured as hollow pipes. The members and beams are joined using conventional "slip-tee" connectors 16 which are also formed of PVC material.

Pivotally connected with the rear lateral member *6a* is a back rest 18 having a U-shaped configuration and also being formed of PVC pipe. The ends of the back rest are connected with the lateral member *6a* via slip-tees 16 which afford pivotal movement of the back rest between a lower horizontal position where the back rest is parallel with the frame (FIG. 2) and an upper vertical position where the back rest is perpendicular to the frame as shown in phantom in FIG. 3.

Pivotally connected with the forward lateral member 6b is a leg rest 20 having a U-shaped configuration and also formed of PVC pipe. The ends of the leg rest are connected with the lateral member 6b via slip-tees 16. The leg rest thus pivots between a lower position wherein the leg rest extends downwardly perpendicular to the frame and an upper position where the leg rest is parallel with the frame as shown in FIGS. 1 and 2.

Figure 6:
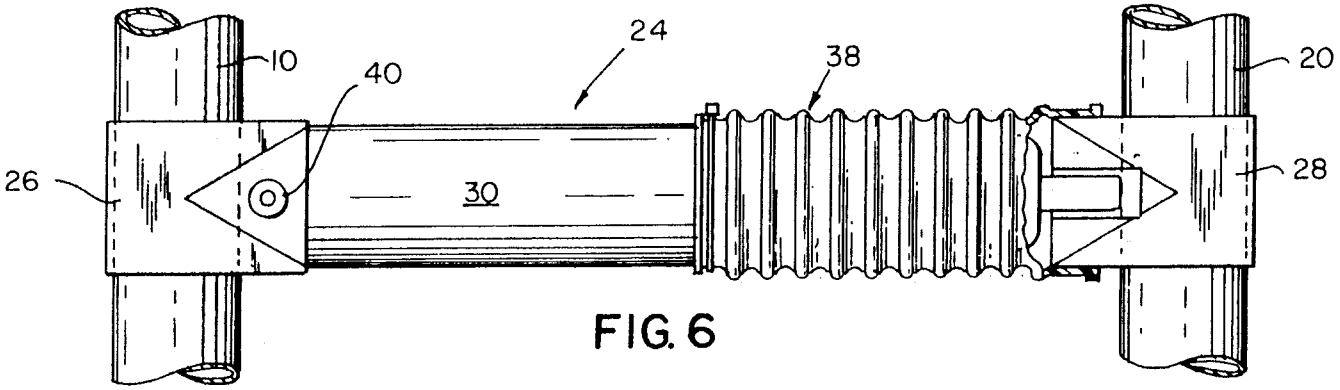
FIGS. 6 and 7 are top plan and side sectional views of a hydraulic piston/cylinder control arm according to the invention.
Figure 7:
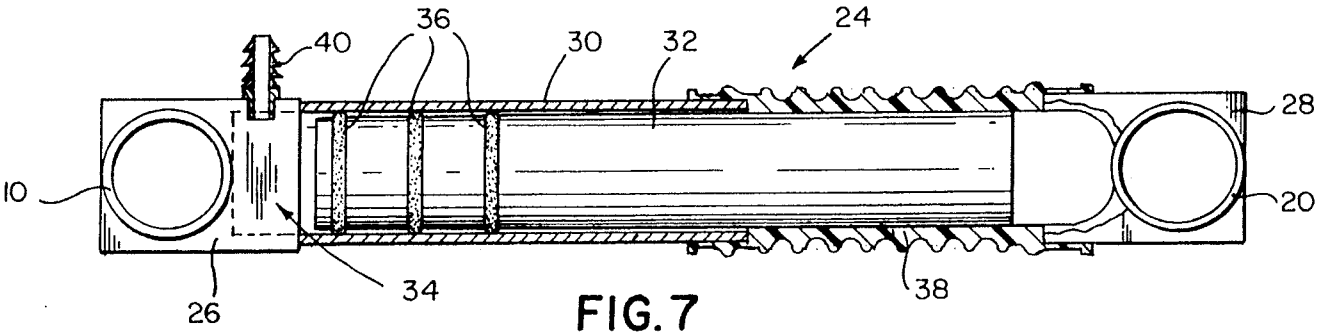

Pivotal movement of the back rest 18 and the leg rest 20 with respect to the frame is controlled independently by selective operation of back rest control arms 22 and leg rest control arm 24. The back rest control arms 22 and the leg rest control arm 24 have the same structure and operation. Accordingly, only the control arm 24 will be described in detail, with reference to FIGS. 6 and 7.

The control arm 24 is a hydraulically operated piston/cylinder having a slip fitting 26 at one end for mounting on the forward frame cross beam 10 and a slip fitting 28 at the other end for mounting on the leg rest 20. The control arm includes an outer cylinder 30 and an inner piston 32 which is extended and retracted with respect to the cylinder as fluid, specifically water, is supplied to and removed from an inner chamber 34 of the cylinder 30, respectively. A plurality of O-rings 36 seal the space between the piston 32 and the cylinder 30 and a bellows 38 accommodates extension of the piston with respect to the cylinder. Water is delivered to the chamber 34 via a fitting 40.

Figure 8:
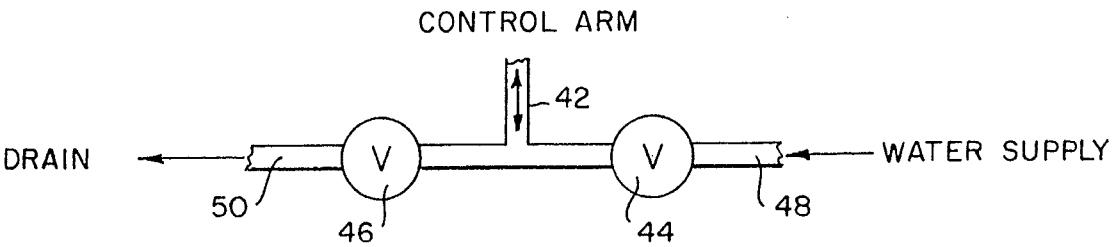
FIG. 8 is a schematic diagram of the fluid supply circuit for the control arms.

Referring now to FIG. 8, a water supply line 42 runs between the fitting 40 of the control arm and a pair of valves 44,46. A supply line 48 is connected between the first valve 44 and a water supply such as a shower head or bathtub spigot. A drain line 50 is connected with the second valve 46 for draining fluid into the tub. The valves are arranged on the side of the frame as shown in FIG. 1 for operation by the individual supported on the chair. With the second valve 46 closed and the first valve 44 opened, water is supplied from the water supply to the leg rest control arm 24 to extend the piston 32. As the piston is extended, the leg rest pivots from the lower position toward the upper position to raise the legs and feet of the individual out of the tub. When the leg rest reaches a selected position—which may be between the lower and upper positions—the valve 44 is closed and the leg rest remains in the selected position. In order to lower the leg rest, the valve 46 is opened and water passes from the chamber 34 to the drain line 50. Applying a slight pressure to the leg rest retracts the piston which allows the leg rest to return to its lower position.

Operation of the back rest occurs in a similar manner. In the preferred embodiment illustrated in FIGS. 1 and 2, two control arms 22 are provided since the force necessary to raise the upper torso of an individual is greater than that required to raise the individual's legs. Of course, differently sized control arms or different numbers of control arms may be provided in accordance with design choices.

The water supply fittings of the back rest control arms 22 are connected in parallel with a supply line 52 shown in FIGS. 1–3 which is connected with third and fourth valves 54,56 in the same manner as the supply line 42 from the leg rest control arm is connected with the first and second valves 44,46. Opening the third valve 54 supplies water from a water supply to the back rest cylinder chambers to extend the back rest pistons and raise the back rest 18 from its lower position toward its upper position. Closing the third valve stops the flow of water to the cylinders and thus retains the back rest in a selected position up to and including its upper position. In FIGS. 1 and 3, the back rest is shown in an intermediate reclining position. Opening the fourth valve 56 with the third valve closed allows water to drain from the back rest cylinders, whereby the back rest may be lowered to its lower prone position.

As set forth above, the frame, back rest, and leg rest are preferably formed of PVC pipe. According to a preferred embodiment, the pipe is furniture grade #80 pipe having a diameter of 1.5 inches. For comfort of the user, a perforated fabric 58 is connected with the pipe of the back rest, frame, and leg rest to comfortably support the user. The fabric is preferably a rot, mildew, and flame resistant nylon material.

The shower lounge chair of the invention provides maximum safety and convenience to the user while bathing. The patient or individual can sit or be placed in the chair as it rests on top of the bathtub cavity. The user can conveniently place his or her legs and feet on the leg rest assembly, lean against the back rest, and shower using a hand held shower head and hose attachment.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. A shower lounge chair for supporting an individual in a bathtub for showering, said bathtub including side walls having upper edges, said shower lounge chair comprising (a) a horizontal frame adapted to rest on the uppper edges of the side walls of the bathtub, said frame including at least two adjustable cross members adapted to engage inner surfaces of said side walls for securing said frame to the bathtub;

(b) a back rest pivotally connected with said frame for movement between a lower position wherein said back rest is parallel to said frame and an upper position wherein said back rest is perpendicular to said frame;

(c) a leg rest pivotally connected with said frame for movement between a lower position wherein said leg rest is perpendicular to said frame and an upper position wherein said leg rest is parallel to said frame; and (d) means for independently pivoting said back rest and said leg rest to selected positions between said lower and upper positions, respectively, whereby when an individual is supported on said frame, said back rest may be pivoted to position the individual between prone and seated positions and said leg rest may be pivoted to suspend the individual's feet and legs in and out of the bathtub.

2. A shower lounge chair as defined in claim 1, wherein said pivoting means comprise control arm means connected between said frame and said back rest and leg rest, respectively.

3. A shower lounge chair as defined in claim 2, wherein said control arm means each comprise a hydraulic piston/cylinder.

4. A shower lounge chair as defined in claim 3, and further comprising (a) a fluid source;

(b) first valve means connected between said fluid source and said back rest; and (c) second valve means connected between said fluid source and said leg rest, said first and second valve means being independently operable to deliver fluid to said piston/cylinders to extend said pistons and raise said back rest and said leg rest, respectively, and to remove fluid from said piston/cylinders to retract said pistons and lower said back rest and said leg rest, respectively.

5. A shower lounge chair as defined in claim 4, wherein said adjustable cross members include struts threadably connected with said frame, said struts being laterally extended to abut against the side walls of the bathtub, thereby to secure said frame to said bathtub.

6. A shower lounge chair as defined in claim 5, wherein said frame comprises a pair of spaced longitudinally extending telescoping members which are adjustable to support the chair on bathtubs of different length.

7. A shower lounge chair as defined in claim 6, and further comprising a layer of perforated fabric connected between said telescoping members for supporting the individual.

8. A shower lounge chair as defined in claim 7, wherein said perforated fabric is connected with at least one of said back rest and leg rest.

9. A shower lounge chair as defined in claim 8, wherein said frame, said back rest, and said leg rest are formed of light weight, rigid pipe.

* * * * *